US008058944B2

(12) United States Patent
Inglis et al.

(10) Patent No.: US 8,058,944 B2
(45) Date of Patent: Nov. 15, 2011

(54) MICROWAVE CIRCULATORS

(75) Inventors: Malcolm William Inglis, Dundee (GB); Grant David Robertson, Dundee (GB); Alan Alexander McNeill, Dundee (GB)

(73) Assignee: Smiths Group PLC (GB)

( * ) Notice: Subject to any disclaimer, the term of this patent is extended or adjusted under 35 U.S.C. 154(b) by 109 days.

(21) Appl. No.: 12/479,457

(22) Filed: Jun. 5, 2009

(65) Prior Publication Data

US 2009/0322440 A1 Dec. 31, 2009

(30) Foreign Application Priority Data

Jun. 6, 2008 (GB) ..... 0810347.5

(51) Int. Cl.
*H01P 1/36* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,935,549 | A | 1/1976 | Jachowski | |
| 4,551,693 | A | 11/1985 | Guidevaux | |
| 6,793,746 | B2 * | 9/2004 | Shimizu et al. | 148/606 |
| 2003/0112089 | A1 * | 6/2003 | Jun et al. | 333/24.2 |
| 2004/0127103 | A1 * | 7/2004 | Kim et al. | 439/638 |

* cited by examiner

*Primary Examiner* — Stephen Jones
(74) *Attorney, Agent, or Firm* — The Belles Group, P.C.

(57) ABSTRACT

A microwave circulator having an outer metal housing with a cavity containing at least one magnet and an annular centring arrangement interposed between the outside of the magnet and the cavity. The centring arrangement includes first and second solid metal rings, the two rings having cooperating inclined faces arranged such that when a force is applied to urge the centring arrangement along the cavity, one ring is displaced outwardly into intimate contact with the inside of the cavity.

8 Claims, 5 Drawing Sheets

MICROWAVE CIRCULATORS

CROSS-REFERENCE TO RELATED PATENT APPLICATIONS

The present application claims priority under 35 U.S.C. §119(a) to Great Britain Patent Application No. GB 0810347.5 filed on Jun. 6, 2008, the disclosure of which is hereby incorporated by reference in its entirety as if set forth fully herein.

This invention relates to microwave circulators.

Microwave circulators are passive electronic devices with two or more ports by which microwave energy is supplied to or from the circulator. Microwave energy is supplied to one port and is routed to the next, adjacent, neighbouring port in a defined direction. The other ports are isolated, that is, no energy enters or leaves these ports. Circulators can be used as isolators by using just two ports and terminating additional port or ports with an RF load. In this way, energy can flow through the circulator between the two operational ports in one direction only. The term "circulator" is used herein to include isolators.

Circulators are used in many applications, such as in satellite receivers, multiplexers and amplifiers, in cellular base stations, broadcasting equipment, radar, linear accelerators and paging equipment. They are used primarily to route signals within sensitive equipment. Circulators are available for use in a range of frequencies from about 100 MHz to 60 GHz. and more.

The relationship between the signal entering the circulator and that leaving the circulator is known as the "transfer function". Ideally, the transfer function should be such that the signal leaving the circulator is as close as possible in form to that entering the circulator. As far as possible, the transfer function should be independent of environmental effects to which the circulator is exposed, such as temperature changes, vibration or the like. However, there are often discontinuities or distortions in the transfer function of conventional circulators, which may be referred to as "glitches". These glitches are often caused by minute changes in the internal electromechanical grounding structure of the circulator. These changes can be caused by, for example, differential thermal expansion of components caused by the use of materials with different coefficients of thermal expansion, intermittent mechanical contact caused by variations in manufacturing tolerances, inconsistency in the size and density of neighbouring parts and localised deformation of parts.

Examples of conventional circulators are given in U.S. Pat. No. 4,551,693 and U.S. Pat. No. 3,935,549.

It is an object of the present invention to provide an alternative circulator.

According to one aspect of the present invention there is provided a microwave circulator having an outer metal housing with a cavity containing at least one magnet and an annular centring arrangement interposed between the outside of the magnet and the cavity, the centring arrangement including first and second solid metal rings, the two rings having cooperating inclined faces arranged such that when a force is applied to urge the centring arrangement along the cavity, one ring is displaced outwardly into intimate contact with the inside of the cavity.

The one ring is preferably a split ring and may have a knurled external surface. The surface of the one ring is preferably coated with a different metal such as silver. The two rings are preferably made of a metal, such as austenitic stainless steel, that does not affect the magnetic field produced by the magnet. The circulator preferably has two magnets and centring assemblies located on opposite sides of electrical contact means.

According to another aspect of the present invention there is provided a microwave circulator having an outer metal housing and a plurality of ports projecting outwardly of the housing by which microwave energy can be supplied to and from the circulator, at least one of the ports being provided with a male coupling and having an outer sleeve formed integrally as a part of the circulator housing itself.

Preferably all the ports of the circulator are formed integrally as a part of the housing. The housing and port or ports are preferably formed of martinsetic stainless steel.

A microwave circulator according to the present invention will now be described, by way of example, with reference to the accompanying drawings, in which.

Figure 1:
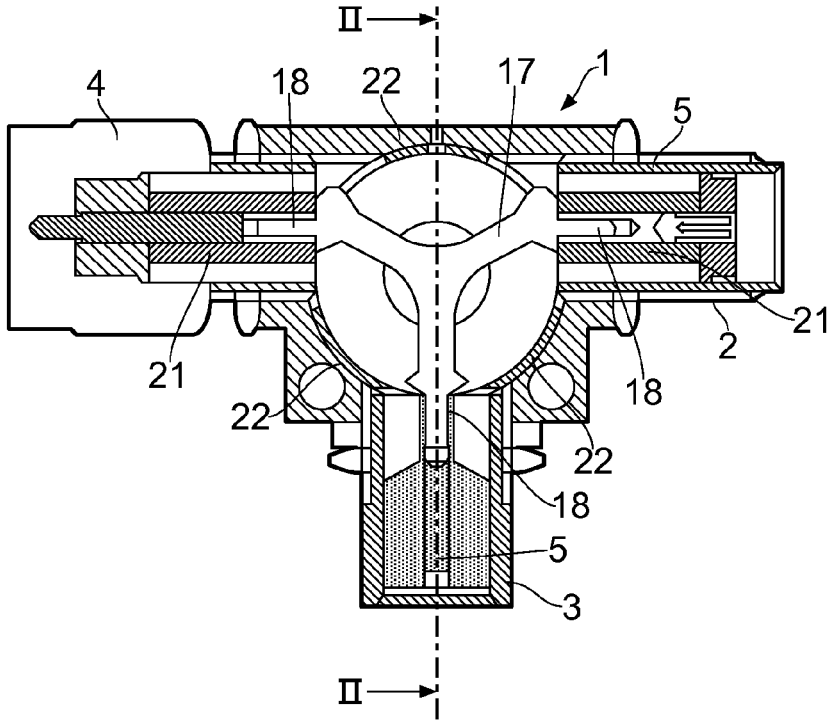
FIG. 1 (PRIOR ART)
FIG. 1 is a sectional plan view of a prior art circulator.
Figure 2:
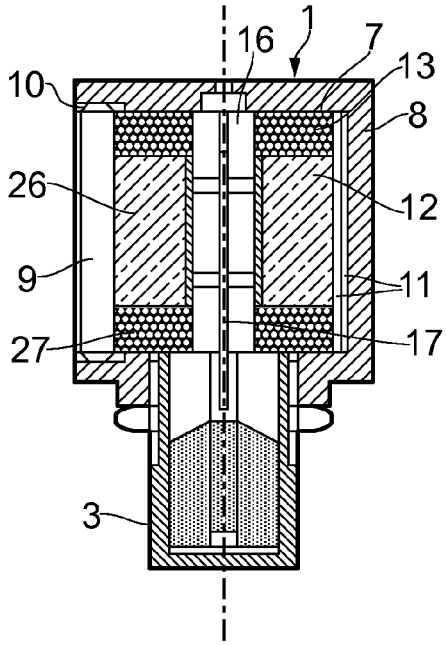
FIG. 2 (PRIOR ART)
FIG. 2 is a cross-sectional side elevation view along the line II-II of FIG. 1.
Figure 3:
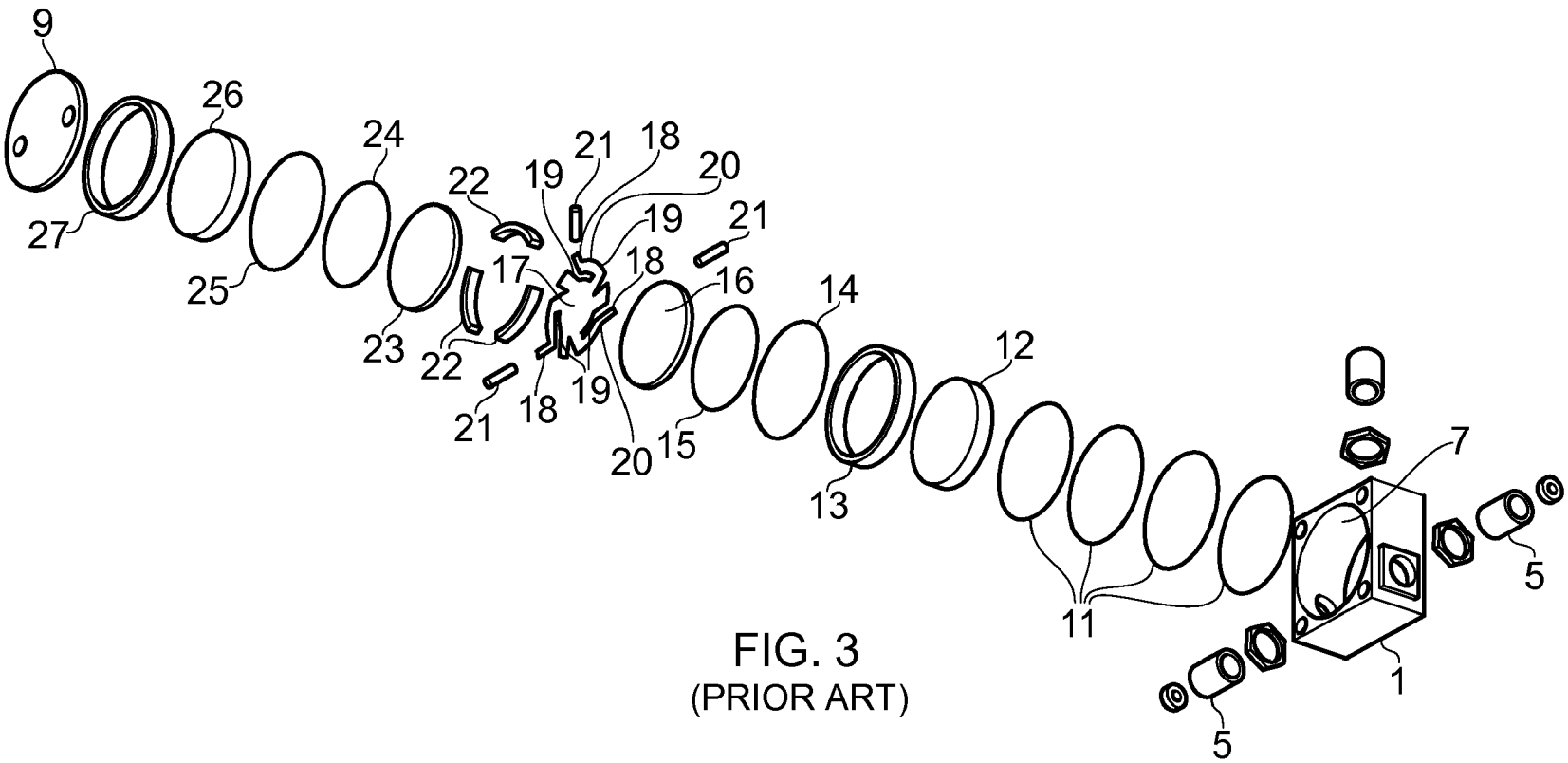
FIG. 3 (PRIOR ART)
FIG. 3 is an exploded view of the prior art circulator shown in FIGS. 1 and 2.
Figure 4:
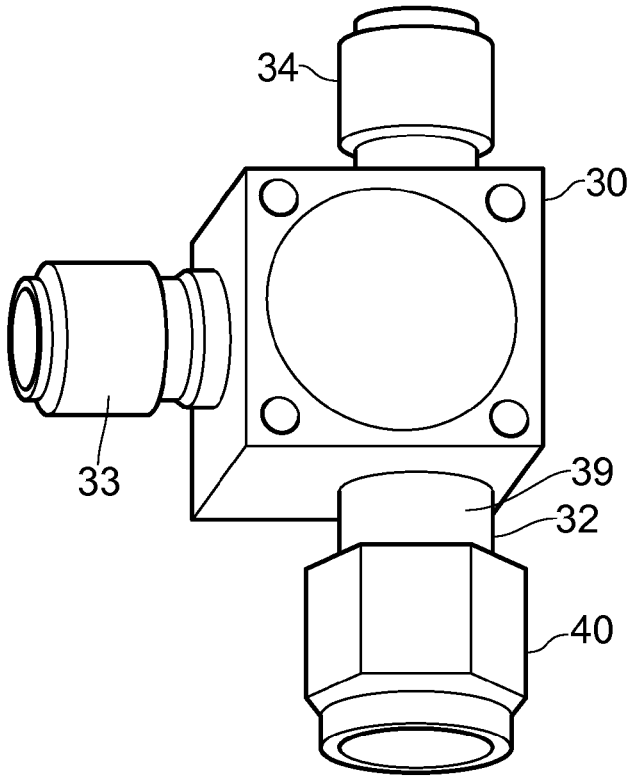
FIG. 4 is a perspective view of the outside of a circulator according to the present invention.
Figure 5:
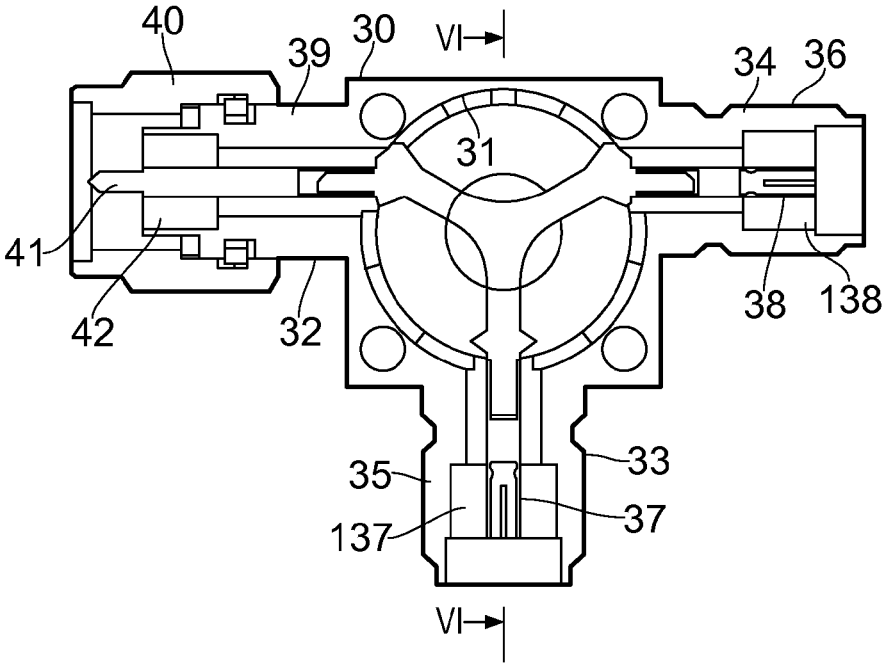
FIG. 5 is a sectional plan view of the circulator of FIG. 4.

An example of a conventional microwave circulator is shown in FIGS. 1 to 3. It has an outer metal housing or body 1 with three ports 2 to 4 spaced around the housing at 90° with respect to one another. Two ports 2 and 3 are of female construction, being adapted to receive a mating male connector (not shown) and the remaining port 4 is of male construction, being adapted to receive a mating female connector (not shown). The shell 5 of each port is made separately of the housing and is screwed into a respective threaded bore 6 in the housing 1. The housing 1 has a central cavity 7 of cylindrical shape and circular section in which various components of the circulator are contained. One end of the cavity 7 is closed by a wall 8 of the housing and the other end is open for assembly but closed subsequently by threaded cover 9 screwed into a threaded section 10 at the outer end of the cavity. The cavity 7 contains four metal ground plane discs 11 stacked on one another with the right-hand disc (as viewed in FIGS. 2 and 3) at one end of the stack abutting the inside of the wall 8 and the left-hand disc being contacted in its central region by one end of a first cylindrical magnet 12. The outer region of the left-hand disc 11 is contacted by one end of a first knitted wire gasket 13 of tubular shape, which extends in an annular gap between the curved outside of the first magnet 12 and the inside of the housing 1. The left-hand face of the magnet 12 and the gasket 13 are contacted by ground plane disc 14, which is in turn contacted by one face of a disc-shape pole piece 15. The opposite face of the pole piece 15 is contacted by the right-hand face of a disc-shape dielectric element 16, typically retaining a ferrite or garnet material (the terms "ferrite" and "garnet" are used herein interchangeably to indicate a ferrite, garnet or other material with similar properties). The left-hand face of the dielectric element 16 contacts one side of a circular contact plate 17. The plate 17 (as shown in FIG. 3) is formed with three tabs 18, which project outwardly. The plate 17 is located midway along the depth of the cavity 7 so that the tabs 18 align with respective ones of the three ports 2 to 4. The tabs 18 are rendered resiliently flexible by means of three slots 19 cut into the plate 17 to divide it into three spring arms 20. The tabs 18 are soldered into respective contact members 21, which project outwardly along the respective ports 2 to 4, the shape of the contact members differing according to whether they provide male or female connectors. Around the outside of the contact plate 17 extend three arc-shape positioning pieces 22, which may or may not act as suppressors of unwanted microwave energy. The remaining components in the cavity 7, on the left-hand side of the contact plate 17, are identical to those on the right-hand side of the contact plate, namely a dielectric/ferrite element 23, a metal pole piece 24, a ground plane plate 25, a second cylindrical magnet 26, and a conductive tubular gasket 27. The cover 9 is screwed into the threaded section 10 of the housing 7 so that it bears on the left-hand end face of the second magnet 26 and the gasket 27 surrounding this.

This conventional circulator relies on the clamping force exerted by the cover plate 9 to compress the gaskets 13 and 27 and force them into close contact with the surrounding metal surfaces.

The circulator of the present invention differs from that described above in that it avoids the need to use a compressible conductive gasket.

The circulator of the present invention is shown in FIGS. 4 to 8. The housing 30 has an external square section with a cylindrical cavity 31 of circular section. The housing 30 is machined from martinsetic stainless steel, because of the magnetic properties of this material, and is typically plated with a protective metal such as nickel, gold or silver. The housing 30 differs from previous housings in that each of the ports 32 to 34 are made integrally with and of the same material as the housing, as a single piece. Two of the ports 33 and 34 are of female construction (as shown most clearly in FIG. 6) having a cylindrical outer sleeve 35 and 36 with a coaxial female socket contact element 37 and 38 respectively. The remaining port 32 is of male construction (as shown most clearly in FIG. 8) having a cylindrical outer sleeve 39 supporting a rotatable hexagonal locking ring 40 and having a male contact pin element 41 extending coaxially within it. The pin 41 is supported by an electrically-insulative collar 42, such as of PTFE. The collar 42 locates within an enlarged recess 142 at the open end of the sleeve 39 and is retained in the sleeve by means of a shallow annular ramp or barb 143 formed around the inside surface of the recess. The slope of the barb 143 is such that it is higher towards the inner end of the recess so that the collar 42 can be pushed into the recess 142 from the open end of the sleeve 39 over the barb but the barb bites into the soft material of the collar to resist outward displacement. The female contact elements 37 and 38 are similarly supported by insulative collars 137 and 138, which are also retained in place by barb surfaces (not visible) on the inside of the sleeves 35 and 36. The ports 32 to 34 illustrated are SMA connectors although they could be of the TNC type or of any other suitable type.

Figure 6:
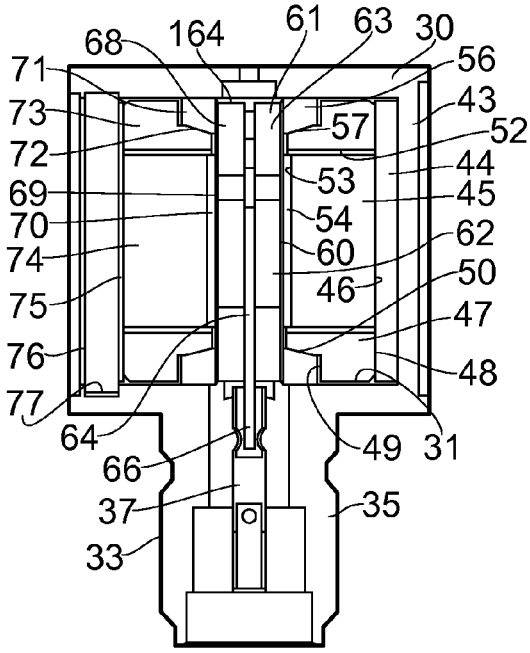
FIG. 6 is an enlarged cross-sectional side elevation view along the line VI-VI of FIG. 5 showing a female connector.
Figure 8:
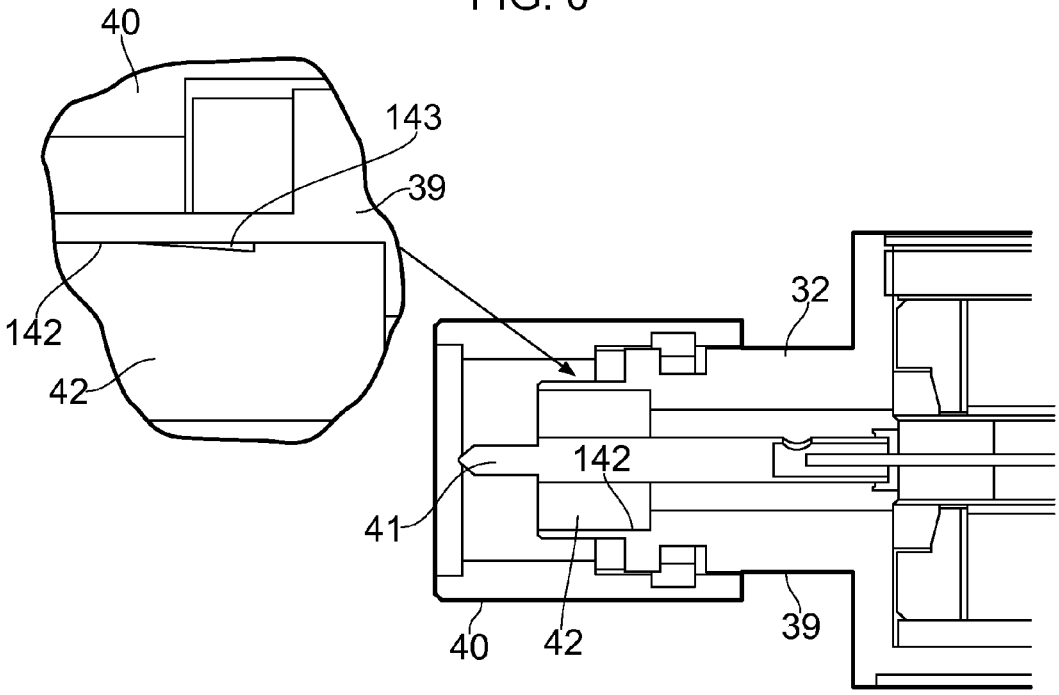
FIG. 8 is a cross-sectional side elevation view through a part of the circulator according to the present invention showing a male connector with an enlarged inset showing.

The components within the housing 30 will now be listed in order from the closed end wall 43 at the right-hand side in FIG. 6. The first component is a disc-shape pole piece or spacer 44 made of a magnetic material, such as a mild steel. A first, inner or bottom magnet 45 of cylindrical shape and of Alnico 8 abuts the centre of the pole piece 44 with its flat right-hand end face 46. The magnet 45 is magnetised axially and is located centrally within the housing 30 by means of a centring arrangement including an annular locating ring 47 and a grounding ring 56, both made of austenitic stainless steel. Austenitic steel is used because it is unaffected by intimate contact with the magnet 45 and does not reduce the strength or homogeneity of the magnetic field. The locating ring 47 has a flat right-hand end face 48 but its opposite, left-hand face 49 is stepped and shaped with an outwardly-facing frusto-conical, tapering or inclined surface 50. The incline of this surface 50 is arranged so that its diameter increases towards the closed, right-hand end of the cavity 31, the angle of the incline being about 30° from the axis of the ring 47. The external diameter of the locating ring 47 is such that it is a close sliding fit within the cavity 31 with the magnet 45 extending along the central bore 52 of the ring. The locating ring 47 is slightly longer than the magnet 45 so that, when both the right-hand end of the ring and magnet abut the pole piece 44, the left-hand end of the ring projects a short distance beyond the left-hand end of the magnet to form a shallow circular recess 53. A second circular pole piece 54 locates in this recess 53, the thickness of the pole piece exceeding slightly the depth of the recess so that the pole piece projects a short distance beyond the end of the recess.

Figure 7:
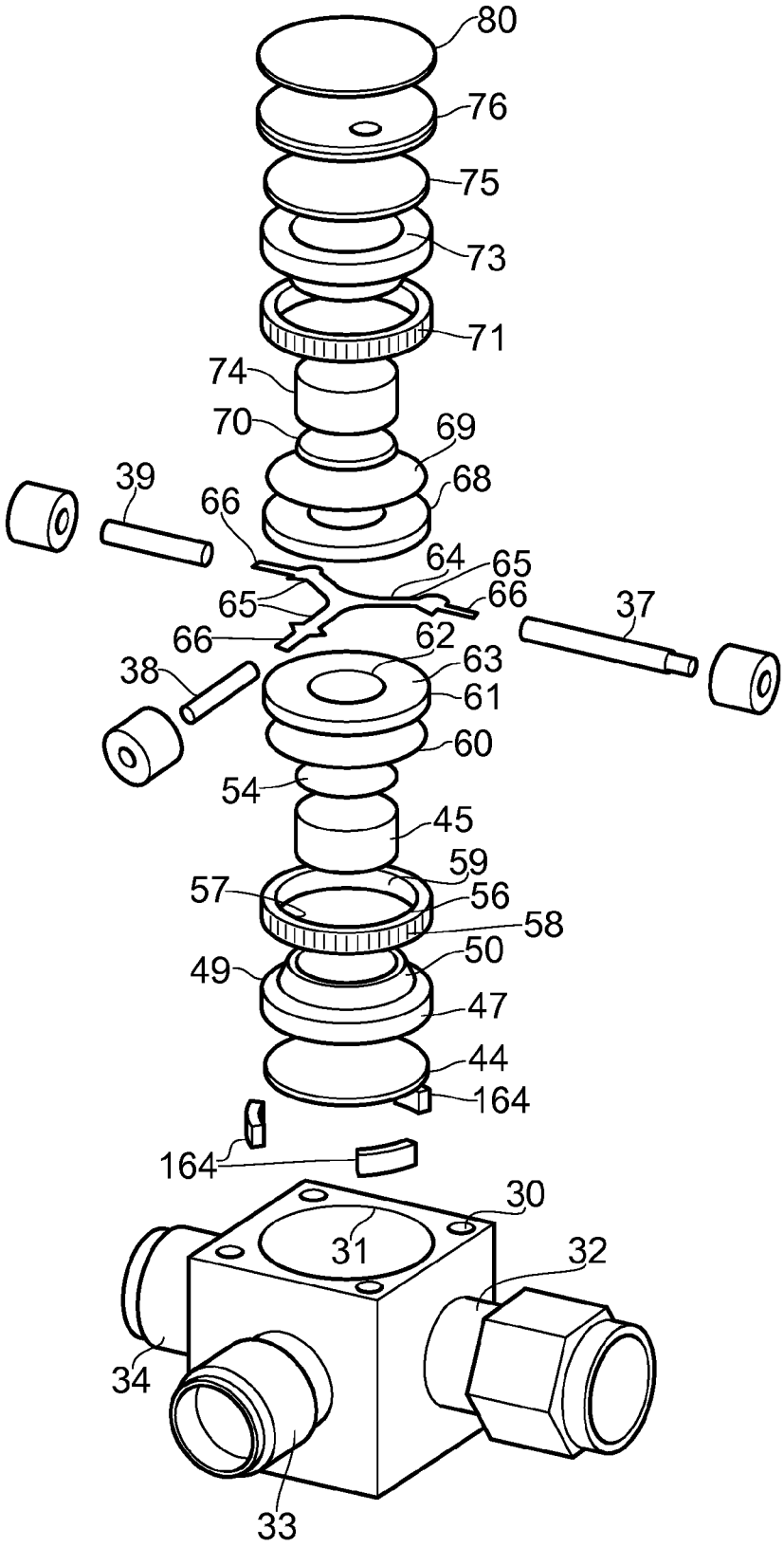
FIG. 7 is an exploded view of the circulator according to the present invention.

The grounding ring 56 surrounds the step formation at the left-hand end 49 of the locating ring 47 and forms a part of the magnet centring arrangement. The grounding ring 56 is of rectangular section with a tapered bore or inner surface 57 forming a frusto-conical surface inclined to match the slope on the inclined surface 50 of the locating ring 47. The external diameter of the grounding ring 56 is matched to that of the locating ring 47 and is a close sliding fit within the cavity 31. The external curved surface of the grounding ring 56 is formed with shallow longitudinal knurls 58 (FIG. 7). The grounding ring 56 is not a complete ring but is cut with a split line 59 to enable it to expand slightly for reasons that will become apparent later. The grounding ring 56 is machined from austenitic steel but is plated on its surfaces with a softer metal having a high electrical conductivity, such as silver. The length and other dimensions of the grounding ring 56 are selected such that, when assembled on the locating ring 47 in the cavity 31 in an uncompressed state, the grounding ring projects a short distance to the left beyond the end of the locating ring and beyond the left-hand end face of the second pole piece 54. In this way, there is a small gap between the right-hand end face of the grounding ring 56 and the left-hand stepped face 49 of the locating ring 47.

The next component in order is a thin ground plane disc 60 of a non-magnetic metal, preferably plated, such as with silver. This disc 60 has substantially the same diameter as the interior of the cavity 31 so that it extends across each of the grounding ring 56, the locating ring 47 and the second pole piece 54. The left-hand face of the ground plane disc 60 contacts the right-hand face of a first ferrite and dielectric disc 61 having a central circular ferrite or garnet element 62 supported by an outer annular support ring 63 of a dielectric material. In some circulators the outer dielectric support ring may not be needed and the entire disc could be of a ferrite, garnet or similar material. The left-hand face of the ferrite and dielectric disc 61 contacts the right-hand face of a T-shape contact piece 64 made of a non-magnetic metal, typically plated. The contact piece 64 has three arms 65 extending outwardly at right angles to one another and terminated by short tabs 66. The contact piece could be of other shapes, such as a Y or star shape. Where the circulator has more than three ports, the contact piece would have the same number of arms. The contact piece 64 is located midway along the cavity 31 in alignment with the three ports 32, 33 and 34. The tabs 66 project a short distance along respective outer sleeves 35, 36 and 37 and into bores at the inner ends of the contact elements 37, 38 and 39. When fully assembled, the tabs 66 are soldered into the respective contact elements 37, 38 and 39. Around the outside of the contact piece 64 extend three, arc-shape positioning strips 164, which also (but optionally) act to suppress unwanted microwave energy. For clarity, in FIG. 7, these strips 164 are shown out of position at the inner end of the stack of components.

Most of the components on the left-hand side of the contact piece 64 are identical to those on its right-hand side and are arranged oppositely. Abutting the left-hand side of the contact piece 64 is a second ferrite and dielectric disc 68, which is contacted on its left-hand face by a ground plane disc 69. This, in turn is contacted centrally on its left-hand face by a pole piece 70 and, around its outer periphery by the right-hand face of a second grounding ring 71. The second grounding ring 71 is identical to the first grounding ring 56 but is oriented oppositely so that its tapered bore 72 has its smaller diameter end towards the inner, right-hand end of the cavity 31. Similarly, the second locating ring 73 is identical to the first ring 47 but is oriented in the opposite sense so that its stepped end faces to the right. A second, outer magnet 74, identical to the first magnet 45, is oriented such that the magnetic fields of the two magnets act to draw them together axially. A thin metal ground plane disc 75 extends across the left-hand face of both the magnet 74 and the locating ring 73. This, in turn, is contacted on its left-hand side by the right-hand side of a circular, threaded lid or cover 76, which is screwed into a short threaded section 77 at the open, left-hand end of the cavity 31 to complete the circulator. FIG. 7 shows the outer surface of the cover 76 covered by an adhesive label 80.

The circulator is assembled by stacking into the lower part of the cavity 31 the inner or lower set of components, namely the first pole piece 44, the magnet 45 and its locating ring 47, the grounding ring 56, the second pole piece 54, and the ground plane disc 60. A clamp or similar tool is then used to apply an axial compressive force between the outer component, that is, the ground plane disc 60 and the closed end wall 43. It will be appreciated that the contacting inclined surface on the grounding ring 56 and the locating ring 47 are such that the grounding ring will be forced outwardly, to expand. The split line 59 formed in the grounding ring 56 allows it to expand as a result of this axial compressive force. As it is forced outwardly, its curved and knurled external surfaces 58 are forced against the inside surface of the housing 30. This force causes some deformation of the knurls 58 into adjacent grooves between the knurls and allows the material of the grounding ring 56 to accommodate any slight irregularities on the surface of the housing 30 to form a close, intimate, low impedance electrical contact between the two surfaces. This contact is further promoted by the nature of the silver plating on the grounding ring 56. The applied axial compressive force also ensures that the abutting flat surfaces of the components are brought into close contact with the ground plane 60, deforming slightly under pressure to ensure that there is a uniform pressure around the circumference of the rings 47 and 56 and that there is close contact with the inside of the end wall 43.

The two ferrite discs 61 and 68 with the intervening contact piece 64 are then stacked on top of the compressed lower components. It is better not to clamp the ferrite discs 61 and 68 with the lower set of components because they are relatively fragile. The remaining upper components, namely the ground plane disc 69, pole piece 70, magnet 74, grounding ring 71, locating ring 73 and ground plane disc 75 are then stacked into the cavity 31. The threaded cover 76 is then screwed down into the recess 77 to apply a light compressive force to the upper components causing expansion of the grounding ring 71 and to maintain the axial compressive force applied to the lower components within the cavity 31.

The present construction provides a high integrity continuous electrical earth path in the circulator and a highly effective EMI performance with little risk of interference caused by leakage of signals into or from the device. The use of austenitic steel for many of the metal components ensures the magnetic field produced by the magnets has a maximum magnitude and homogeneity. The arrangement of the circulator of the present invention substantially reduces possible sources of minute changes in the electromechanical grounding structure and thereby reduces the occurrences of glitches within the circulator.

The circulator need not have two magnets and their associated components but could just have one magnet or more than two. Forming the shells of the ports integrally with the main housing of the circulator, instead from separate components attached with the housing, avoids the risk of any changes in the electromechanical properties in the region of the junctions between the shells and the housing. It would, however, be possible for the circulator to have connector ports formed in the conventional manner. The circulator could have only two ports or more than three and the ports could provide any combination of female and male connectors.

The invention claimed is:

1. A microwave circulator having an outer metal housing with a cavity containing at least one magnet and an annular centring arrangement interposed between the outside of the magnet and the cavity, the centring arrangement including first and second solid metal rings, the two rings having cooperating inclined faces arranged such that when a force is applied to urge the centring arrangement along the cavity, one ring is displaced outwardly into intimate contact with the inside of the cavity.

2. A microwave circulator as claimed in claim 1, in which the second ring which may be displaced outwardly is a split ring.

3. A microwave circulator as claimed in claim 2 in which the second ring has a knurled external surface.

4. A microwave circulator as claimed in claim 3 in which the two rings are made of a metal that does not affect the magnetic field produced by the magnet.

5. A microwave circulator as claimed in claim 4, in which the two rings are made of austenitic stainless steel.

6. A microwave circulator as claimed in claim 5 in which the second ring is coated with a different metal such a silver.

7. A microwave circulator as claimed in claim 6 in which the circulator has two magnets and centring assemblies located on opposite sides of electrical contact means.

8. A microwave circulator having an outer metal housing with a cavity containing at least one magnet and an annular centring arrangement interposed between the outside of the magnet and the cavity, the centring arrangement including first and second solid metal rings, the two rings having cooperating inclined faces arranged such that when a force is applied to urge the centring arrangement along the cavity, one ring is displaced outwardly into intimate contact with the inside of the cavity; the circulator also having a plurality of ports projecting outwardly of the housing by which microwave energy can be supplied to and from the circulator, at least one of the ports being provided with a male coupling and having an outer sleeve formed integrally as part of the circulator housing itself.

* * * * *